US011002259B2

(12) United States Patent
Rittmeyer

(10) Patent No.: US 11,002,259 B2
(45) Date of Patent: May 11, 2021

(54) VARIABLE WOBBLER FOR A HYDRAULIC UNIT

(71) Applicant: Hamilton Sundstrand Corporation, Charlotte, NC (US)

(72) Inventor: Gregory Alan Rittmeyer, Winnebago, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 16/210,308

(22) Filed: Dec. 5, 2018

(65) Prior Publication Data

US 2020/0182228 A1 Jun. 11, 2020

(51) Int. Cl.

| | |
|---|---|
| ***F04B 1/20*** | (2020.01) |
| ***F04B 1/2078*** | (2020.01) |
| ***F03C 1/06*** | (2006.01) |

(52) U.S. Cl.

CPC ..... *F04B 1/2078* (2013.01); *F03C 1/0668* (2013.01)

(58) Field of Classification Search

CPC ..... F04B 1/146; F04B 1/2078; F03C 1/0668
See application file for complete search history.

(56) References Cited

U.S. PATENT DOCUMENTS

2010/0322789 A1 12/2010 Betz et al.
2016/0201697 A1* 7/2016 Campbell ..... F04B 1/2078 92/13

FOREIGN PATENT DOCUMENTS

EP 3045721 A1 7/2016
FR 2502255 A1 9/1982

OTHER PUBLICATIONS

Extended European Search Report dated May 25, 2020, issued during the prosecution of European Patent Application No. EP 19213410.4.

* cited by examiner

*Primary Examiner* — Abiy Teka
(74) *Attorney, Agent, or Firm* — Locke Lord LLP; Scott D. Wofsy; Joshua L. Jones

(57) ABSTRACT

A variable wobbler for a hydraulic unit is disclosed, which includes body defining a central vertical axis, a horizontal longitudinal axis and a horizontal transverse axis, and including an exterior surface having a segmented outer peripheral edge and a circular inner peripheral edge extending around the central vertical axis, wherein a datum point is located on a first lateral segment of the outer peripheral edge of the exterior surface, and wherein a 45 degree relief angle is formed between the outer peripheral edge of the first lateral segment and a datum line that extends through the datum point in a direction that is perpendicular to the horizontal longitudinal axis.

12 Claims, 4 Drawing Sheets

VARIABLE WOBBLER FOR A HYDRAULIC UNIT

BACKGROUND OF THE INVENTION

1. Field of the Invention

The subject invention is directed to an integrated drive generator, and more particularly, to a variable wobbler of a hydraulic unit of an integrated drive generator used in aerospace applications.

2. Description of Related Art

Aircraft currently rely upon electrical, pneumatic and hydraulic systems for secondary power generation. A typical electrical system in an aircraft utilizes an integrated drive generator (IDG) coupled to a gas turbine engine to provide fixed frequency power to the power distribution system and to a variety of loads.

An exemplary IDG includes a generator, a hydraulic unit and a differential assembly arranged in a common housing. The differential assembly is coupled to a gas turbine engine by way of an input shaft. The rotational speed of the input shaft varies during the operation of the gas turbine engine. The hydraulic unit cooperates with the differential assembly to provide a constant speed to the generator throughout the operating range of the engine operation.

Due to design constraints, certain components of the hydraulic unit of the IDG, such as the variable wobbler must be redesigned to reduce the weight of the system. For example, the variable wobbler disclosed in U.S. Patent Application Publication 2016/0201697, which is incorporated herein by reference, has been redesigned to reduce weight by removing excess material from certain surfaces of the component. This redesign has resulted in the new and useful variable wobbler component of the subject invention.

SUMMARY OF THE DISCLOSURE

The subject invention is directed to a variable wobbler for a hydraulic unit, which includes a body defining a central vertical axis, a horizontal longitudinal axis and a horizontal transverse axis. The body further includes an exterior surface having a segmented outer peripheral edge and a circular inner peripheral edge extending around the central vertical axis.

A datum point is located on a first lateral segment of the outer peripheral edge of the exterior surface, and a 45 degree relief angle is formed between the outer peripheral edge of the first lateral segment and a datum line that extends through the datum point in a direction that is perpendicular to the horizontal longitudinal axis. Preferably, the datum point is located approximately 1.00 inch from the horizontal longitudinal axis and approximately 1.40 inches from the horizontal transverse axis.

A first trunnion extends radially outwardly from a first side portion of the body along the horizontal longitudinal axis of the body, a second trunnion extends radially outwardly from a second side portion of the body along the horizontal longitudinal axis of the body. The inner peripheral edge of the exterior surface circumscribes an annular inner contact surface, and the annular inner contact surface has a friction-reducing coating thereon. Preferably, the friction-reducing coating is an amorphous diamond-like carbon coating.

The exterior surface of the body includes diametrically opposed upstanding projections for limiting wobble rotation of the variable wobbler, wherein each projection has a planar upper surface with opposed lateral edges and three outer peripheral edge segments. Preferably, each projection has a widthwise dimension that is about 0.75 inches.

The subject invention is also directed to a hydraulic unit for an integrated drive generator, which includes a housing defining an interior chamber, and a variable wobbler operatively supported within the interior chamber of the housing. The variable wobbler includes a body defining a central vertical axis, horizontal longitudinal and transverse axes, and an exterior surface having a segmented outer peripheral edge and a circular inner peripheral edge extending around the central vertical axis. A datum point is located on a first lateral segment of the outer peripheral edge of the exterior surface, and a 45 degree relief angle is formed between the outer peripheral edge of the first lateral segment and a datum line that extends through the datum point in a direction that is perpendicular to the horizontal longitudinal axis.

These and other features of the variable wobbler of the subject invention will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those having ordinary skill in the art will readily understand how to make and use the system components of the subject invention without undue experimentation, preferred embodiments thereof will be described in detail herein below with reference to the figures wherein.

DETAILED DESCRIPTION OF THE PREFERRED EMBODIMENTS

Figure 1:
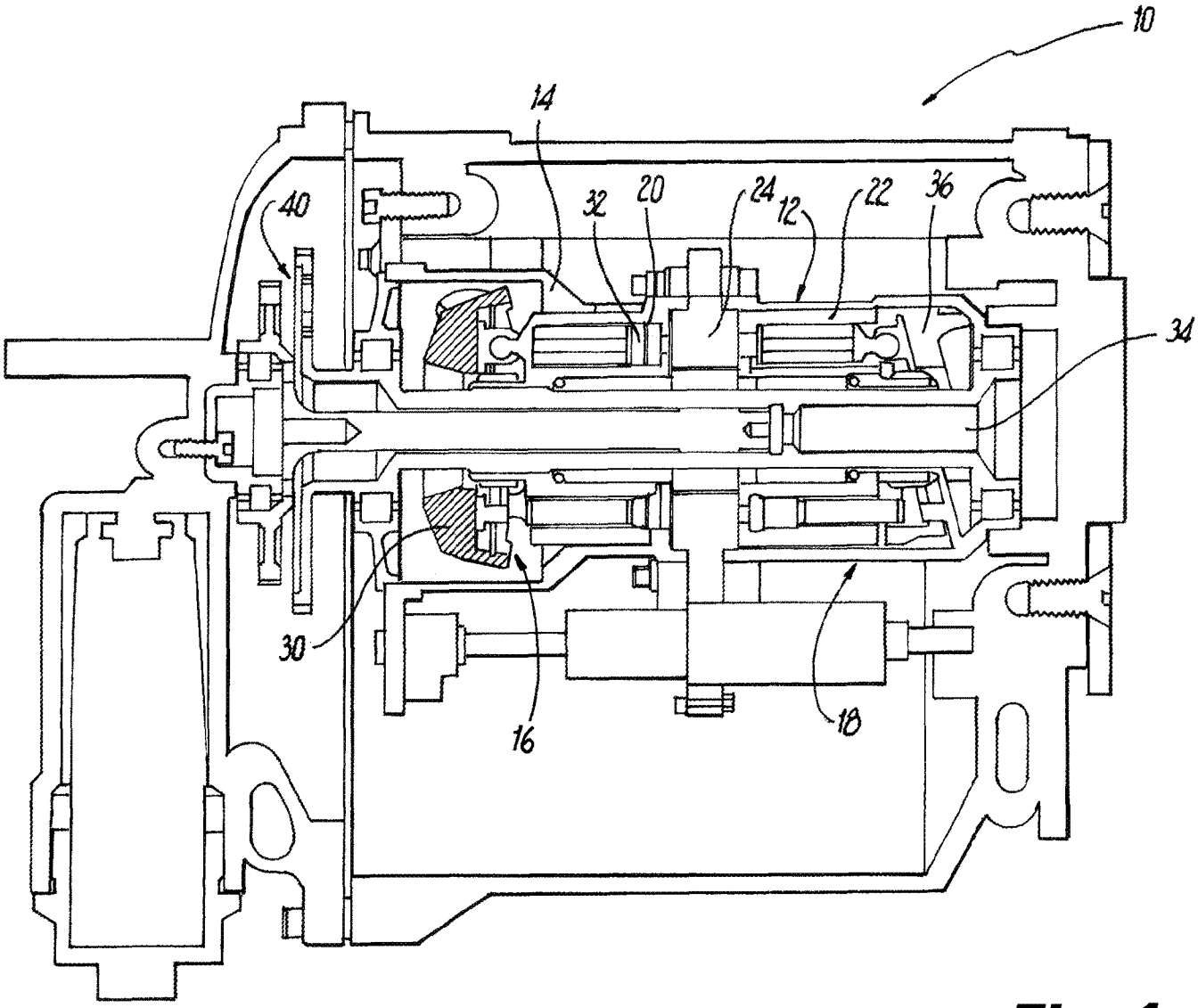
FIG. 1 is a cross-sectional schematic view of an example of an integrated drive generator (IDG) used in conjunction with a gas turbine engine, which includes a hydraulic unit that contains the variable wobbler of the subject invention.
Figure 2:
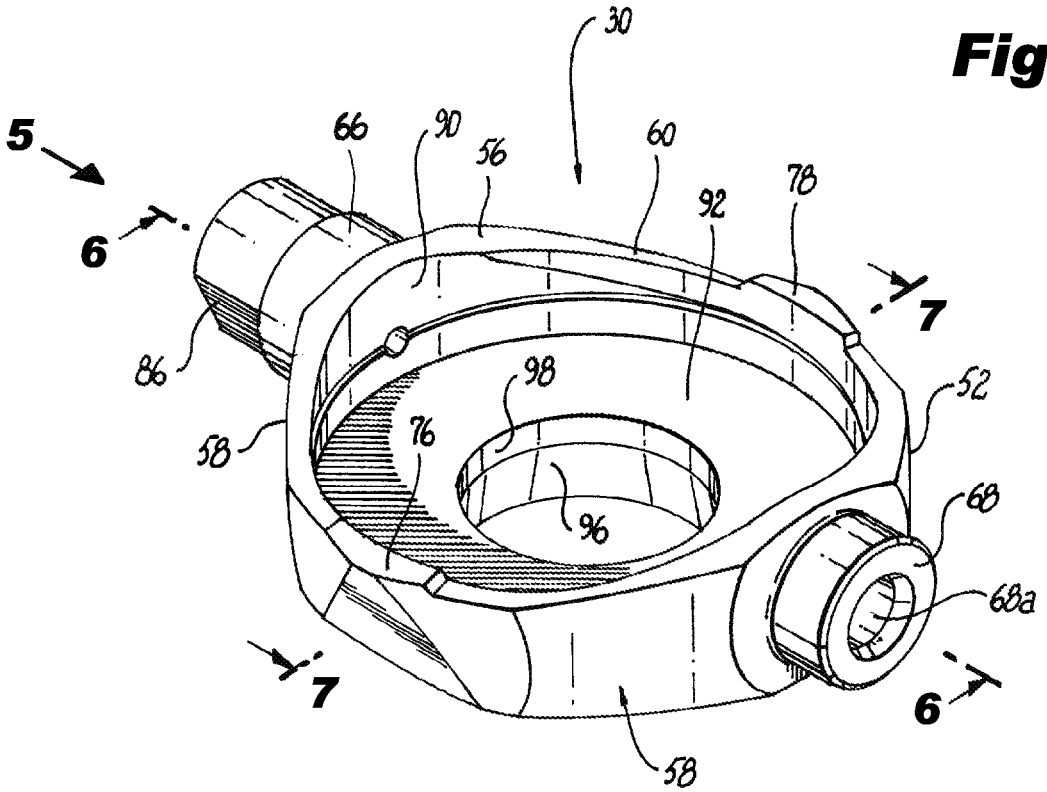
FIG. 2 is a perspective view of the variable wobbler of the subject invention.

Referring now to the drawings wherein like reference numerals identify similar structural elements or features of the subject invention, there is illustrated in FIG. 1 an integrated drive generator (IDG) designated generally by reference numeral 10. The IDG 10 is designed to be coupled to the spool of a gas turbine engine through an accessory drive gearbox (not shown).

More particularly, the IDG 10 includes an input shaft that receives rotational drive from an accessory drive gearbox.

The rotational speed of the input shaft varies depending upon the operation of the gas turbine engine. A hydraulic unit 12 housed within the IDG 10 cooperates with a differential assembly to convert the variable rotational speed of the input shaft to a fixed rotational output speed supplied to a generator.

With continuing reference to FIG. 1, the hydraulic unit 12 of the IDG 10 has a housing 14 that supports a variable displacement hydraulic pump 16 and a fixed displacement hydraulic motor 18. The pump 16 and motor 18 have respective cylinder blocks 20 and 22 which are arranged for rotation about a common axis within the housing 14 on opposite sides of a stationary port plate 24. The port plate 24 is formed with apertures to enable hydraulic fluid communication between the pump 16 and motor 18 and maintain a hydrostatic balance between the cylinder blocks 20 and 22, during normal operation of the hydraulic unit 12.

The operation of the hydraulic unit 12 in IDG 10 of an aircraft involves transmission of torque from a gas turbine engine of the aircraft to an input of the IDG, which rotates an input drive gear or gear shaft 40 of the hydraulic unit 12. The cylinder block 20 of the pump 16 is connected to the gear shaft 40 for rotation therewith. Pistons 32 within the cylinder block 20 of pump 16 are displaced during this rotation by an amount that is related to the position of a variable wobbler 30 of the pump 16. More particularly, the stroke of each piston 32 within cylinder block 20 depends upon the angular position of the variable wobbler 30 relative to the central axis of the hydraulic unit 12.

Hydraulic fluid under pressure from the pump 16 is delivered to the motor 18 through the port plate 24 to rotate the cylinder block 22 and an output shaft 34 to which it is fixedly connected. A fixed wobbler 36 is associated with output shaft 34 so that the operating speed of the motor 18 is a function of the displacement of the pump 16.

The rotary output from shaft 34 is added to or subtracted from the rotary motion provided by the engine through the differential gearing of the IDG 10 so that the electrical generator will be operated at a substantially constant rotational speed. That is, since the rotational speed from the engine to the input shaft 40 will vary, the position of the variable wobbler 30 is adjusted in response to the detected speed variations. This provides the necessary reduction or increase in speed, so as to obtain the desired constant output speed to the generator.

Referring now to FIGS. 2 through 9, there is illustrated in greater detail the variable wobbler 30 of hydraulic unit 12, which is configured to contact the pistons 32 of cylinder block 20 and rotate about the longitudinal axis of the hydraulic unit 12 to vary a wobble rotation thereof. The variable wobbler 30 includes a body 50 having a first end portion 52 and a second end portion 54. The wobbler body 50 defines a central vertical axis "z" (see FIG. 6), a horizontal longitudinal axis "x" and a horizontal transverse axis "y" (see FIG. 4). The first end portion 52 of the body 50 further includes an exterior surface 56 that has a segmented outer peripheral edge 58 and a circular inner peripheral edge 60, which extends around the central vertical axis of the body 50.

Figure 4:
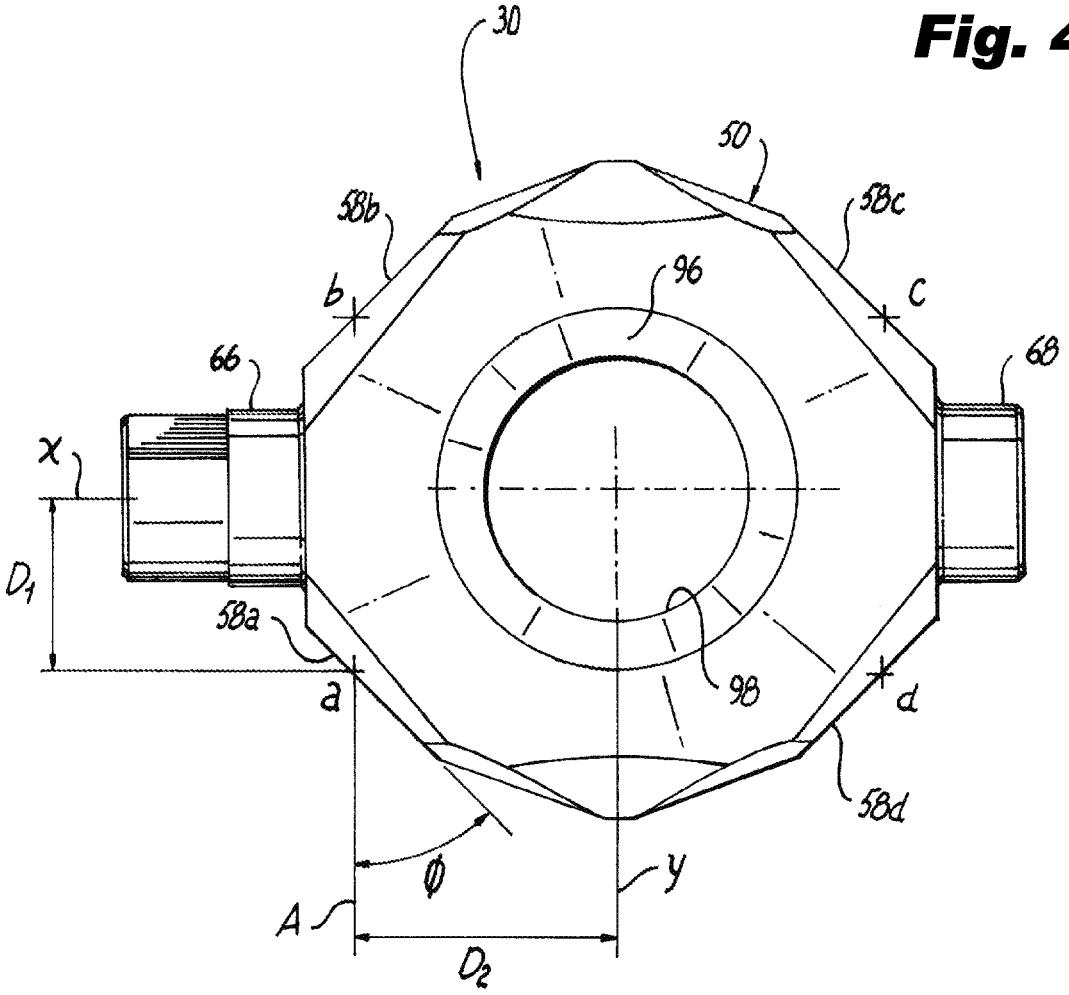
FIG. 4 is a second plan view of the variable wobbler of FIG. 2.

Referring to FIG. 4, a datum point "a" is located on a first lateral segment 58*a* of the outer peripheral edge 58 of the exterior surface 56. A 45 degree relief angle "0" is formed between the outer peripheral edge 58 of the first lateral segment 58*a* and a datum line "A" that extends through the datum point "a" in a direction that is perpendicular to the horizontal longitudinal axis "x". Preferably, the datum point "a" is located a distance $D_1$ from the horizontal longitudinal axis "x" and a distance $D_2$ from the horizontal transverse axis "y". In an embodiment of the subject invention, the distance $D_1$ is approximately 1.00 inch and the distance $D_2$ is approximately 1.40 inches.

Identical datum points "b", "c" and "d" are respectively located on the lateral segments 58*b*, 58*c* and 58*d* of the outer peripheral 58 of the exterior surface 56, as reference points for forming 45 degree relief angles between the lateral segments and corresponding datum lines, as described above with respect to the first lateral segment 58*a*. This geometry represents an improvement over the geometry of the variable wobbler disclosed in U.S. Patent Application Publication 2016/0201697, to the extent that excess material has been removed from the exterior surfaces of the prior art wobbler body to create the geometric form of the subject wobbler body 50, best seen in FIG. 2, and thereby reduce the overall weight of this component of the hydraulic unit 12.

Figure 5:
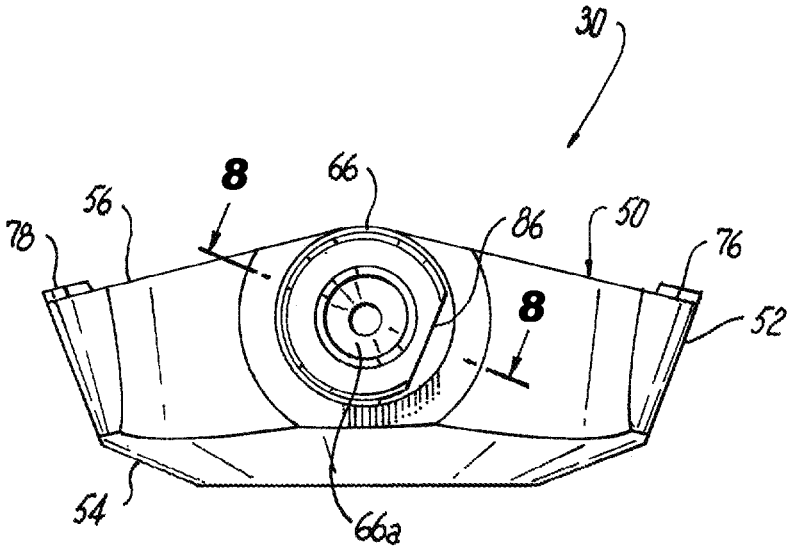
FIG. 5 is a first end view of the variable wobbler of the subject invention.
Figure 8:
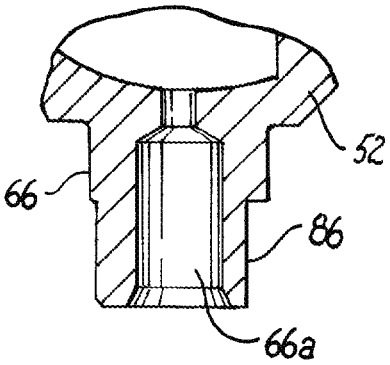
FIG. 8 is a localized cross-sectional view taken along line 8-8 of FIG. 5.

The first end portion 52 of the body 50 of wobbler 30 includes a first and second trunnions 66 and 68. The first trunnion 66 extends radially outwardly from a first side portion of the body 50 along the horizontal longitudinal axis "x" and the second trunnion 68 extends radially outwardly from a second side portion of the body 50 along the horizontal longitudinal axis "x". The first trunnion 66 has an axial bore 66*a* formed therein, as best seen n FIG. 6. The second trunnion 68 has an axial bore 68*a* formed therein, as best seen in FIG. 8. As shown in FIG. 5, the first trunnion 66 has a flat surface 86 which enables a control arm or similar component of the hydraulic unit 12 to rotate the variable wobbler 30 about its axis to adjust the wobble angle thereof.

Figure 9:
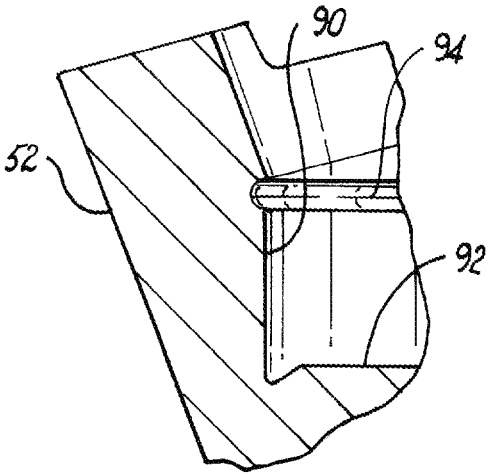
FIG. 9 is an enlarged localized cross-sectional view taken from FIG. 7

The inner peripheral edge 60 of the exterior surface 56 of the body 50 circumscribes an annular wall 90 that surrounds an inner contact surface 92. An annular groove 94 is formed in the annular wall 90 for supporting a retaining ring, as best seen in FIG. 9. The inner contact surface 92 has a friction-reducing coating thereon. Preferably, the friction-reducing coating on the annular inner contact surface 92 is an amorphous diamond-like carbon coating. This coating may be disposed on contact surface 92 by physical vapor deposition or a similar coating technique. The coating has a thickness of approximately 1-4 microns.

Figure 3:
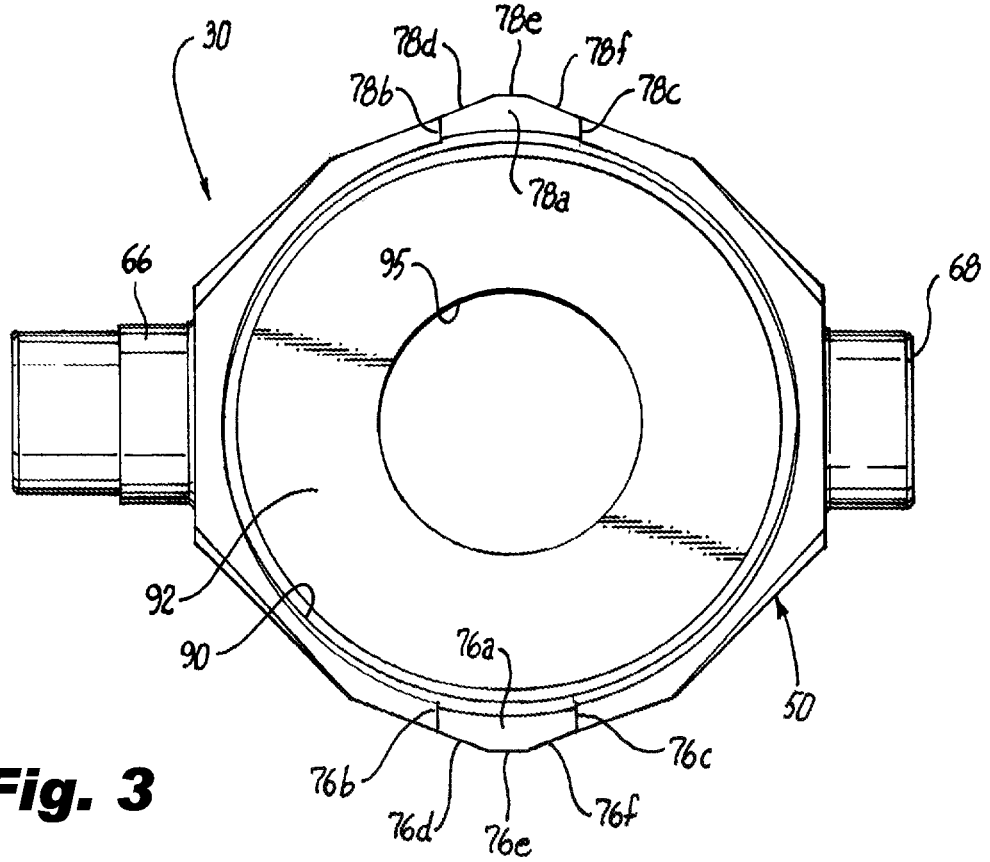
FIG. 3 is a first plan view of the variable wobbler of FIG. 2.

Referring to FIG. 3, the exterior surface 56 of the first end portion 52 of body 50 includes diametrically opposed upstanding projections 76 and 78 for limiting the amount of wobble rotation of the variable wobbler. Projection 76 has a planar upper surface 76*a* with opposed lateral edges 76*b* and 76*c*, and three outer peripheral edge segments 76*d*, 76*e* and 76*f*. Similarly, projection 78 has a planar upper surface 78*a* with opposed lateral edges 78*b* and 78*c*, and three outer peripheral edge segments 78*d*, 78*e* and 78*f*. Preferably, each projection 76 and 78 has a widthwise dimension $D_3$, as measured from one lateral edge thereof to the other lateral edge thereof, that is about 0.75 inches, as shown in FIG. 6.

Figure 6:
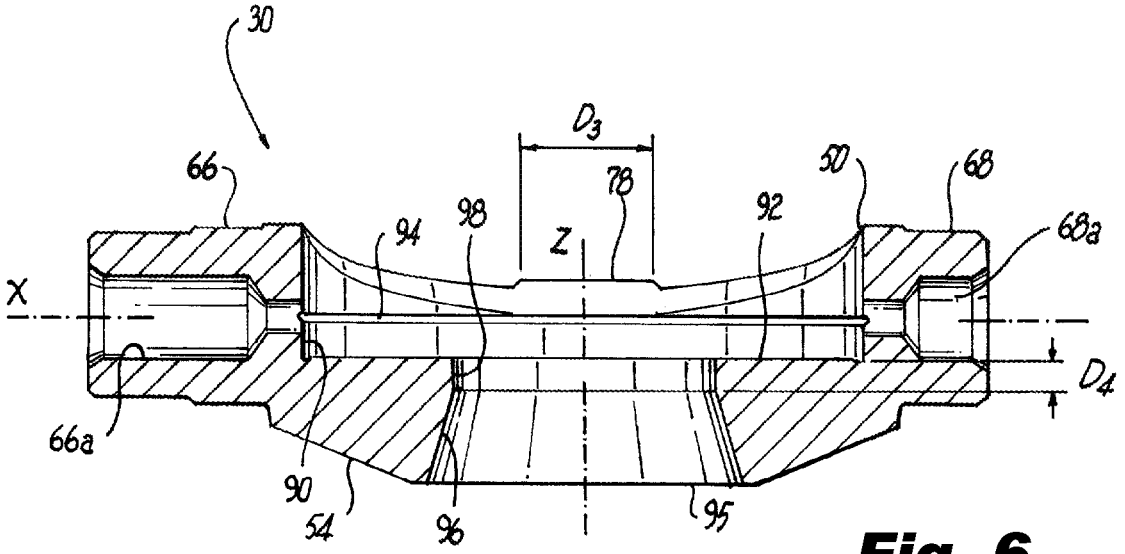
FIG. 6 is a cross-sectional view of the variable wobbler shown in FIG. 2, taken along line 6-6.
Figure 7:
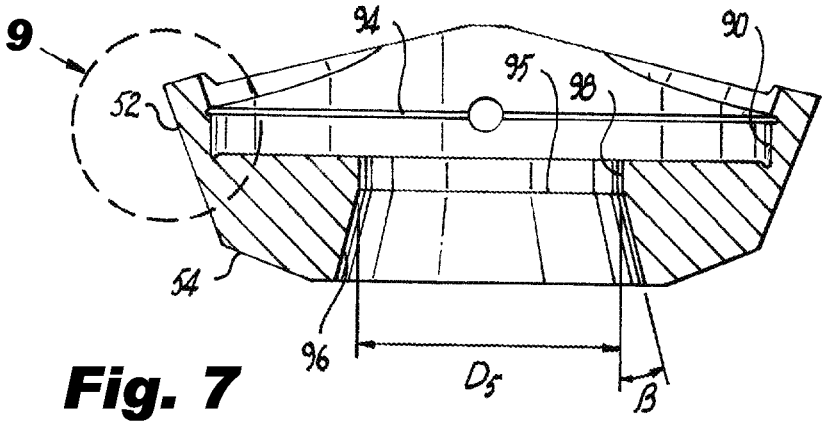
FIG. 7 is a cross-sectional view of the variable wobbler shown in FIG. 2, taken along line 7-7.

Referring now to FIGS. 6 and 7, the second end portion 54 of the body 50 of wobbler 30 includes a central bore 95 that has a conical inner wall portion 96 and a cylindrical inner wall portion 98. The cylindrical inner wall portion 98 has an axial height $D_4$ of about 0.18 inches and an inner diameter $D_5$ of about 1.45 inches. The angle "β" of the conical inner wall portion 96 relative to the cylindrical wall portion 98 is about 15 degrees.

While the subject disclosure has been shown and described with reference to preferred embodiments, those skilled in the art will readily appreciate that changes and/or modifications may be made thereto without departing from the scope of the subject disclosure.

What is claimed is:

1. A variable wobbler for a hydraulic unit, comprising:

a body defining a central vertical axis, a horizontal longitudinal axis intersecting the central vertical axis, and a horizontal transverse axis intersecting the central vertical axis and the horizontal longitudinal axis perpendicular to the horizontal longitudinal axis, and including an exterior surface having a segmented outer peripheral edge and a circular inner peripheral edge extending around the central vertical axis, wherein a datum point is located on a first lateral segment of the outer peripheral edge of the exterior surface, and wherein a 45 degree relief angle is formed between the outer peripheral edge of the first lateral segment and a datum line that extends through the datum point in a direction that is perpendicular to the horizontal longitudinal axis, wherein the datum point is located 1.00 inch from the horizontal longitudinal axis, wherein the datum point is located 1.40 inches from the horizontal transverse axis.

2. A variable wobbler as recited in claim 1, wherein a first trunnion extends radially outwardly from a first side portion of the body along the horizontal longitudinal axis of the body.

3. A variable wobbler as recited in claim 2, wherein a second trunnion extends radially outwardly from a second side portion of the body along the horizontal longitudinal axis of the body.

4. A variable wobbler as recited in claim 1, wherein the inner peripheral edge of the exterior surface circumscribes an annular inner contact surface.

5. A variable wobbler as recited in claim 4, wherein the annular inner contact surface has a friction-reducing coating thereon.

6. A variable wobbler as recited in claim 5, wherein the friction-reducing coating is an amorphous diamond-like carbon coating.

7. A variable wobbler as recited in claim 6, wherein each projection has a widthwise dimension that is about 0.75 inches.

8. A variable wobbler as recited in claim 1, wherein the exterior surface of the body includes diametrically opposed upstanding projections for limiting wobble rotation of the variable wobbler, wherein each projection has a planar upper surface with opposed lateral edges and three outer peripheral edge segments.

9. A hydraulic unit for an integrated drive generator, comprising:

a) a housing defining an interior chamber;

b) a variable wobbler operatively supported within the interior chamber of the housing and including a body defining a central vertical axis, horizontal longitudinal and transverse axes, the horizontal longitudinal and transverse axes each perpendicularly intersecting the central vertical axis and the horizontal longitudinal axis perpendicularly intersecting the horizontal transverse axis, and including an exterior surface having a segmented outer peripheral edge and a circular inner peripheral edge extending around the central vertical axis, wherein a datum point is located on a first lateral segment of the outer peripheral edge of the exterior surface, and wherein a 45 degree relief angle is formed between the outer peripheral edge of the first lateral segment and a datum line that extends through the datum point in a direction that is perpendicular to the horizontal longitudinal axis, wherein the datum point is located 1.00 inch from the horizontal longitudinal axis and 1.40 inches from the horizontal transverse axis.

10. A variable wobbler as recited in claim 9, wherein a first trunnion extends radially outwardly from a first side portion of the body along the horizontal longitudinal axis of the body and a second trunnion extends radially outwardly from a second side portion of the body along the horizontal longitudinal axis of the body.

11. A variable wobbler as recited in claim 9, wherein the inner peripheral edge of the exterior surface circumscribes an annular inner contact surface, and wherein the annular inner contact surface has an amorphous diamond-like carbon coating.

12. A variable wobbler as recited in claim 9, wherein the exterior surface of the body includes diametrically opposed upstanding projections for limiting wobble rotation of the variable wobbler, each projection having a planar exterior surface with opposed lateral edges and three outer peripheral edge segments, and wherein each projection has a widthwise dimension that is about 0.75 inches.

* * * * *